United States Patent [19]

Edelson et al.

[11] Patent Number: 4,604,183

[45] Date of Patent: Aug. 5, 1986

[54] CATALYTIC PROCESS FOR HYDROCONVERSION OF SOLID CARBONACEOUS MATERIALS

[75] Inventors: Edward H. Edelson, Maple Shade; Edward I. Stiefel, Bridgewater; Russell R. Chianelli, Somerville, all of N.J.; Catherine L. Coyle, Karlsruhe, Fed. Rep. of Germany

[73] Assignee: Exxon Research and Engineering Co., Florham Park, N.J.

[21] Appl. No.: 741,993

[22] Filed: Jun. 6, 1985

[51] Int. Cl.[4] ..... C10G 1/00

[52] U.S. Cl. ..... 208/420; 502/164; 502/220; 502/224; 208/110; 208/108

[58] Field of Search ..... 208/10; 502/164, 220, 502/224

[56] References Cited

U.S. PATENT DOCUMENTS

| | | | |
|---|---|---|---|
| 4,259,167 | 3/1981 | Liotta | 208/8 LE |
| 4,300,994 | 11/1981 | Liotta | 208/8 LE |
| 4,300,995 | 11/1981 | Liotta | 208/8 LE |
| 4,338,183 | 7/1982 | Gatsis | 208/10 |
| 4,363,714 | 12/1982 | Liotta et al. | 208/10 |
| 4,510,260 | 4/1985 | Stiefel et al. | 502/164 |
| 4,514,517 | 4/1985 | Ho et al. | 502/164 |

*Primary Examiner*—John Doll
*Assistant Examiner*—Lance Johnson
*Attorney, Agent, or Firm*—Wayne Hoover

[57] ABSTRACT

An improved hydroconversion process for carbonaceous materials wherein an ammonium or hydrocarbyl substituted ammonium salt of a metal-sulfur analog of cubane having an anion with a core structure of $M_4S_4$ is used as a catalyst precursor. In the general formula, M may be the same or a different metal having hydrogenation catalytic activity when used as a sulfide and capable of occupying one or more vertices in a cubane structure. The metal may also have the capability of bridging one or more such structures. The improved process is effective for both normally solid and normally liquid carbonaceous materials and for carbonaceous materials which are either solid or liquid at the conversion conditions. The hydroconversion will be accomplished at a temperature within the range from about 500° to about 900° F., at a total pressure within the range from about 500 to about 7000 psig and at a hydrogen partial pressure within the range from about 400 to about 5000 psig.

19 Claims, 1 Drawing Figure

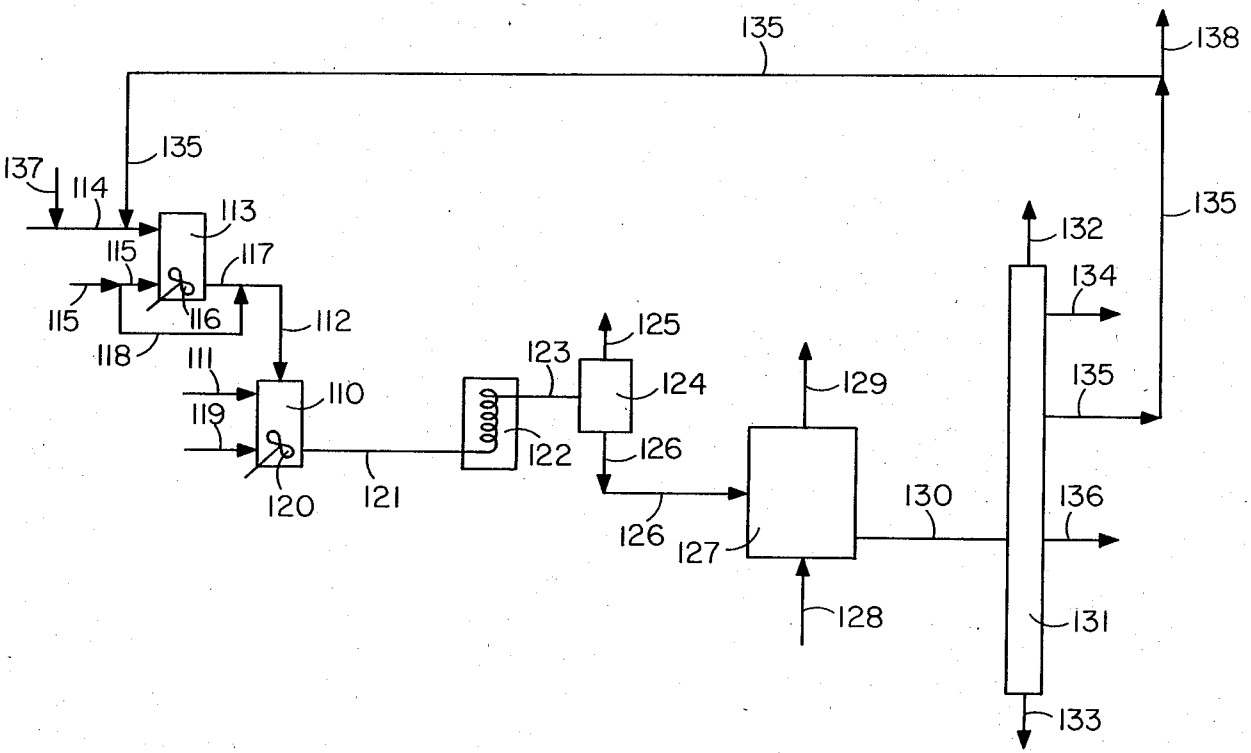
138
135
132
134
135
136
131
133
130
129
128
135
127
125
124
126
126
123
122
121
112
110
120
113
117
116
111
119
135
115
118
114
115
137

CATALYTIC PROCESS FOR HYDROCONVERSION OF SOLID CARBONACEOUS MATERIALS

BACKGROUND OF THE INVENTION

This invention relates to an improved process for hydroconverting carbonaceous materials to lower molecular weight products. More particularly, this invention relates to an improved catalytic process for hydroconverting carbonaceous materials to lower molecular weight products.

Heretofore, several catalytic processes for hydroconverting solid carbonaceous materials such as coal, lignite, peat and the like to lower molecular weight products and for converting heavier petroleum fractions such as atmospheric and vacuum residuals to lower molecular weight products have been proposed. The lower molecular weight products may be gaseous or liquid or a mixture of both. In general, the production of liquid products is particularly desirable since liquid products are more readily stored and transported and the lower molecular weight liquid products are often conveniently used as motor fuels.

Heretofore, a large number of suitable catalysts have been identified as useful in such hydroconversion processes. For example, transition metal sulfides and oxides and mixtures thereof have been particularly useful as catalysts in such processes. Moreover, a host of catalyst precursors; that is, compounds that will either decompose or are readily converted to an active sulfide or oxide form, have been identified. Such precursors include transition metal complexes such as transition metal naphthenates and heteropoly metal acids and inorganic compounds such as ammonium salts of transition metals. In general, the precursors used have either been soluble, to some extent, in the reaction medium itself or in a solvent which is either added to the reaction medium or used to facilitate impregnation. The solvents heretofore employed have been both organic and inorganic.

As is well known in the prior art, the effectiveness of the transition metal sulfide and oxide catalyst precursors has been limited by their respective solubilities at atmospheric conditions or upon heating in the reaction media itself or in the solvent used to incorporate the same into the reaction media. While the reason or reasons for this limitation on catalytic activity is not well known, it is believed to be due either to the particle size of the active catalyst species ultimately formed in the reaction media or as a result of poor distribution of the active catalyst species within the reaction mixture. Moreover, most, if not all, of the precursor species proposed heretofore require a treatment of some kind with a sulfur compound before the more active sulfide catalyst species is ultimately obtained. Since the catalytic processes heretofore proposed have experienced effectiveness limitations due either to the formation of relatively large particle size catalyst species or as a result of poor distribution of the catalyst species within the reaction media and since most, if not all, require some treatment with a sulfur compound, the need for an improved catalytic process wherein the catalytic activity is improved either as a result of reduced particle size or improved distribution and wherein a special treatment with a sulfur compound is not required is believed to be readily apparent.

SUMMARY OF THE INVENTION

It has now been discovered that the foregoing and other disadvantages of the prior art catalytic processes can be avoided, or at least reduced, with the method of the present invention and an improved process for converting carbonaceous materials to lower molecular weight products provided thereby. It is, therefore, an object of this invention to provide an improved catalytic process for the conversion of carbonaceous materials to lower molecular weight products. It is another object of this invention to provide such a catalytic process wherein the active catalyst species or species formed is either relatively small or at least is more uniformly distributed thereby yielding increased conversions. It is still a further object of this invention to provide such a catalytic process wherein a treatment with a sulfur compound is not needed to convert the catalyst precursor to an active sulfide catalyst species. The foregoing and other objects and advantages will become apparent from the description set forth hereinafter and from the drawing appended thereto.

In accordance with the present invention, the foregoing and other objects and advantages are accomplished by converting a carbonaceous material to lower molecular weight products in the presence of a metal sulfide or a mixture of metal sulfides, which sulfide or mixture of such sulfides is formed either prior to or during the conversion process through the decomposition of an ammonium and/or a hydrocarbyl substituted ammonium salt of a metal-sulfur analog of cubane or a mixture of such cubane analogs. As pointed out more fully hereinafter, the total conversion of the carbonaceous material to lower molecular weight products will vary with the particular analog of cubane or mixture thereof used in the anion portion of the salt and with the particular cation or cations employed.

BRIEF DESCRIPTION OF THE DRAWINGS

The FIGURE is a schematic flow diagram of a process within the scope of the present invention.

DETAILED DESCRIPTION OF THE INVENTION

As indicated, supra, the present invention relates to an improved catalytic process for converting carbonaceous materials to lower molecular weight products wherein an ammonium and/or a hydrocarbyl substituted ammonium salt of a metal-sulfur analog of cubane or a mixture thereof is used as a catalyst precursor (which precursors shall hereinafter be referred to generically as salts of a cubane analog). As also indicated, supra, the conversion of the carbonaceous material will take place in the presence of molecular hydrogen at an elevated temperature and pressure. As further indicated previously and as will be described more fully hereinafter, the relative activity of the metal sulfide or mixtures thereof formed from the precursor will vary with the anion and cation portions of the salt of the cubane analog.

In general, the method of the present invention can be used to convert any non-gaseous carbonaceous material to lower molecular weight products. The carbonaceous material may then be either normally solid or normally liquid and may be either solid or liquid at conversion conditions. Suitable normally solid carbonaceous materials include, but are not necessarily limited to, coal, trash, biomass, coke, tar sand, bitumen, certain petroleum residue and the like. This invention is particularly useful in the catalytic liquefaction of coal and may be used to liquefy any of the coals known in the prior art including bituminous coal, subbituminous coal, lignite, peat, brown coal and the like. These materials are, at least initially, solid at conversion conditions. Suitable carbonaceous materials which may be normally liquid, include, but are not necessarily limited to, materials remaining after a crude oil has been processed to separate lower boiling constituents, such as atmospheric and vacuum petroleum residuals. In general, petroleum residuals will have an initial boiling point within the range from about 650° F. to about 1150° F. The petroleum residuals will, in all cases, be liquid at the conditions used to effect the catalytic conversion in the improved process of this invention. The improved process of this invention is also particularly applicable to the conversion of crude oil bottoms from a vacuum distillation column having an initial boiling point within the range of from about 850° F. to about 1050° F.

In general, and when a carbonaceous material, which is solid at the conversion conditions, is converted in the improved process of this invention, the same will be ground to a finely divided state. The particular particle size or particle size range actually employed, however, is not critical to the invention and, indeed, essentially any particle size can be employed. Notwithstanding this, generally, the solid carbonaceous material which may be liquefied in accordance with this invention, will be ground to a particle size of less then ¼ inch and preferably to a particle size of less than about 8 mesh (N.B.S. sieve size).

In the improved process of the present invention, the carbonaceous material may be combined with a solvent or diluent either before or after the catalyst precursor is added thereto. In this regard, it should be noted that a solid carbonaceous material can be impregnated with a catalyst precursor prior to adding a suitable solvent or diluent while the precursor may be added directly to a liquid carbonaceous material before any solvent or diluent is added. Moreover, when a liquid carbonaceous material is converted in the improved process of this invention, the use of a solvent or diluent is neither critical nor essential. In a preferred embodiment of the present invention, however, a solvent or diluent will be used and a precursor soluble in said solvent or diluent will be dissolved in the solvent or diluent prior to combining the solvent or diluent with the carbonaceous material to be converted.

The catalyst precursors useful in the improved process of the present invention are salts of a cubane analog or thiocubane having a general core structure of $M_4S_4$ wherein M is a metal having hydrogenation catalytic activity when used as a sulfide and capable of occupying one or more of the vertices in a cubane structure or of bridging a plurality of such structures. Metals having hydrogenation catalytic activity are well known in the prior art and include the metals of Groups IV-B, V-A, VI-A, VII-A and VIII-A of the Periodic Table of Elements as copyrighted by Sargent-Welch Scientific Company, 1979. Molybdenum, tungsten and iron are particularly effective when used in the precursors of the present invention. Suitable salts of a cubane analog wherein four metal ions occupy vertices in the thiocubane structure as illustrated by the following formula:

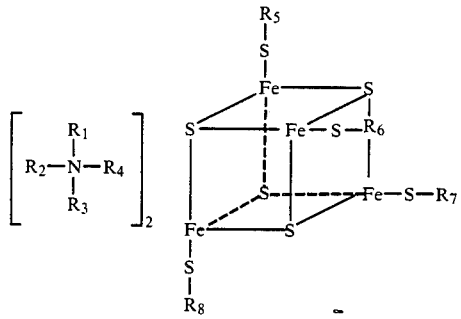

1.

Wherein:

$R_1$, $R_2$, $R_3$ and $R_4$ may be the same or a different radical selected from the group consisting of: hydrogen ($H^+$); $C_1$–$C_{18}$ alkyl groups; $C_5$–$C_8$ cycloalkyl groups, $C_5$–$C_{18}$ alkyl substituted cycloalkyl groups; $C_6$–$C_{18}$ aromatic groups and $C_7$–$C_{18}$ alkyl substituted aromatic groups; and $R_5$, $R_6$, $R_7$ and $R_8$ may be the same or a different hydrocarbyl radical selected from the group consisting of $C_1$–$C_{18}$ alkyl radicals; $C_5$–$C_8$ cycloalkyl radicals; $C_5$–$C_{18}$ alkyl substituted cycloalkyl radicals; $C_6$–$C_{18}$ aromatic radicals and $C_7$–$C_{18}$ alkyl substituted aromatic radicals.

This compound may be prepared by reacting in alcoholic solvent in appropriate thiol (RSH) with an alkali metal alkoxide salt and adding the resultant thiolate-containing solution to a solution of iron(III) chloride in the alcohol. Sulfur is then added to the resulting solution to form the complex anion which, after filtration, is added to a solution of a tetraalkylammonium salt to precipitate the desired complex. The reactions believed to be occurring are represented as follows:

$$Na^+OCH_3^- + RSH \rightarrow Na^+RS^- \quad (1)$$

$$4RS^- + Fe^{3+} \rightarrow Fe(SR)^-4 \quad (2)$$

$$4Fe(SR)_4^- + \tfrac{1}{2}S_8 \rightarrow Fe_4S_4(SR)_4^{2-} \quad (3)$$

$$Fe_4S_4(SR)_4^{2-} + 2NR_4^+ \rightarrow (NR_4)_2[Fe_4S_4(SR)_4] \quad (4)$$

Suitable salts of a cubane analog wherein a metal ion bridges a plurality of cubane analog structures are illustrated by formula 2 and 3 below:

2.

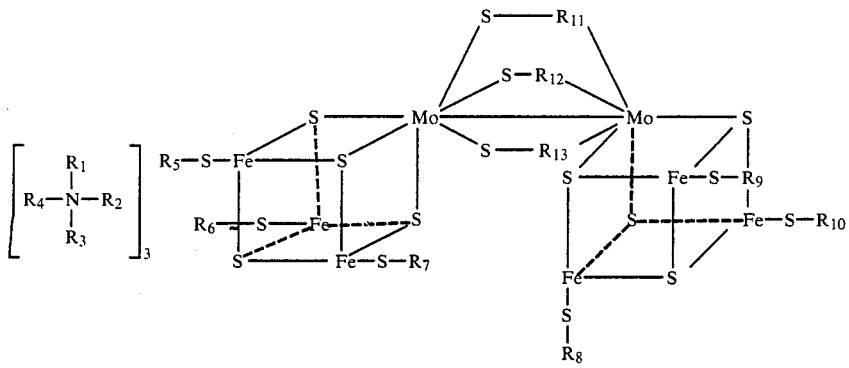

Wherein:

$R_1$, $R_2$, $R_3$ and $R_4$ may be the same or a different moiety selected from the group consisting of: hydrogen ($H^+$); $C_1$–$C_{18}$ alkyl groups; $C_5$–$C_8$ cycloalkyl groups; $C_6$–$C_{18}$ alkyl substituted cycloalkyl groups; $C_6$–$C_{18}$ aromatic groups and $C_7$–$C_{18}$ alkyl substituted aromatic groups; and $R_5$, $R_6$, $R_7$, $R_8$, $R_9$, $R_{10}$, $R_{11}$, $R_{12}$ and $R_{13}$ may be the same or a different hydrocarbyl radical selected from the group consisting of $C_1$–$C_{18}$ alkyl radicals; $C_5$–$C_8$ cycloalkyl radicals; $C_5$–$C_{18}$ alkyl substituted cycloalkyl radicals; $C_6$–$C_{18}$ aromatic radicals and $C_7$–$C_{18}$ alkyl substituted aromatic radicals.

This class of compounds may be prepared by first making the sodium thiolate salt in an alcohol solvent as described above and then adding ferric chloride to this solution. Addition of ammonium tetrathiomolybdate will yield the complex anion which, after filtration, may be added to a solution of a tetralkylammonium salt to precipitate the desired complex. The overall reactions are presumed to be:

(1) $FeCl_3 + NaSR + MoS_4^{2-} \rightarrow$ anion in above salt (2) Anion in above salt $+ 3\ NR_4^+ \rightarrow$ salt shown above cals; $C_6$–$C_{18}$ aromatic radicals and $C_7$–$C_{18}$ or alkyl substituted aromatic radicals.

This class of compounds is prepared by first making the sodium thiolate salt in an alcohol solvent as described above and then adding ferric chloride to this solution. Addition of ammonium tetrathiotungsdate yielded the complex anion which, after filtration, was added to a solution of a tetralkylammonium salt to precipitate the desired complex. The overall reactions are presumed to be:

(1) $FeCl_3 + NaSR + WS_4^{2-} \rightarrow$ to the anion in the above salt (2) Anion in above salt $+ 3\ NR_4^+ \rightarrow$ the above salt In general, the catalyst will be added to or combined with the carbonaceous material at a concentration within the range from about 10 ppm to about 10,000 ppm, by weight, metal based on dry, ash-free (DAF) carbonaceous material. The catalyst precursor may be added to the solvent and then combined with the carbonaceous material when a solvent is employed or the catalyst precursor may be added or combined with the carbonaceous material and then the solvent. When a solvent is not used, particularly with a normally liquid carbonaceous material, the catalyst precursor may be combined directly with the carbonaceous material.

3.

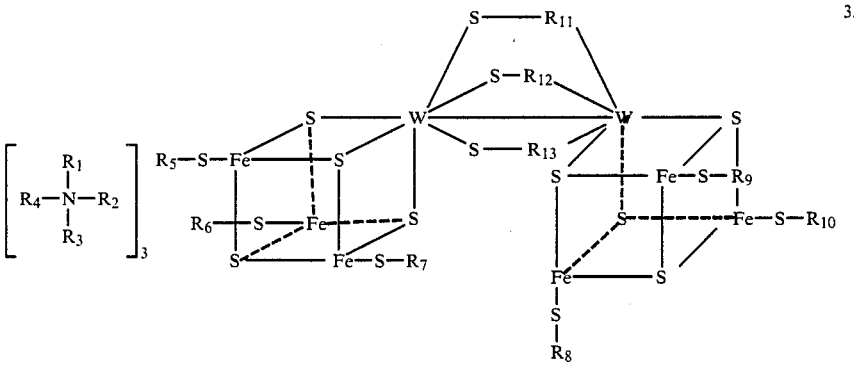

Wherein:

$R_1$, $R_2$, $R_3$ and $R_4$ may be the same or a different moiety selected from the group consisting of: hydrogen ($H^+$); $C_1$–$C_{18}$ alkyl groups;$C_5$–$C_8$ cycloalkyl groups; $C_6$–$C_{18}$ alkyl substituted cycloalkyl group; $C_6$–$C_{18}$ aromatic groups and $C_7$–$C_{18}$ alkyl substituted aromatic groups; and $R_5$, $R_6$, $R_7$, $R_8$, $R_9$, $R_{10}$, $R_{11}$, $R_{12}$, and $R_{13}$ may be the same or a different hydrocarbyl radical selected from the group consisting of $C_1$–$C_{18}$ alkyl radicals; $C_5$–$C_8$ cycloalkyl radicals; $C_5$–$C_{18}$ alkyl substituted radi- After the catalyst precursor or a mixture thereof has been combined with the carbonaceous material, the same will be converted to an active catalyst species and particularly to the corresponding sulfide or mixture of sulfides by heating the combination of carbonaceous material and catalyst precursor or precursors either in the presence or absence of the solvent to a temperature at which the salts of the cubane analogs are converted to the corresponding sulfide as a result of the sulfur already contained in the salt. While the actual temperature or temperatures at which the conversion from salt of an analog of cubane to sulfide occurs will vary depending upon the anion and the cation contained in the salt, the conversion will, however, generally occur at a temperature within the range from about ambient to about 750° F.

While the inventors do not wish to be bound by any particular theory, it is believed that the relative catalytic activity will vary with the particular cation contained in the precursor since these ions will vary the temperature at which the salt of the cubane analog will be converted to the corresponding metal sulfide. In this regard, it should be noted that precursors having lower decomposition temperatures tend to lead to the formation of catalytically active species which are more active (or more uniformly distributed in the reaction media) than do precursors having higher decomposition temperatures.

While a separate conversion step of the precursor or a mixture thereof to an active catalyst form is contemplated in the improved process of the present invention, such a separate conversion is not necessary. This is especially true when overall conversions resulting from conversion of the precursor at the same or a lower temperature than that used during the carbonaceous material conversion is acceptable. Moreover, and when a separate conversion step is employed, the precursor will, generally, be decomposed to the corresponding sulfide in an inert atmosphere and in the absence of hydrogen.

After the mixture of catalyst precursor and carbonaceous material has been prepared, either with or without a solvent, and the precursor converted to an active catalyst form, when a separate decomposition step is used or during heat-up of the mixture when a separate decomposition step is not used, the mixture will be passed to a carbonaceous material conversion zone and at least a portion of the carbonaceous material will be converted to lower molecular weight products in the presence of hydrogen. In general, the conversion will be accomplished at a temperature within the range from about 500° F. to about 1000° F. and at a total pressure within the range from about 500 psig to about 7000 psig. Molecular hydrogen will be present during the conversion at a partial pressure within the range from about 400 to about 5000 psig. In general, the conversion of the carbonaceous material may be accomplished either in a single stage or in a plurality of stages. In any case, the total nominal holding time at conversion conditions will, generally, range from about 10 minutes to about 600 minutes. Moreover, and while significant conversions will be realized when catalyst concentration is maintained within the aforementioned range (10 ppm to 10,000 ppm, by weight metal based on carbonaceous feed material, DAF) on a once-through basis, the catalyst concentration, and hence, catalytic activity in any stage or stages can be increased by recycling bottoms material containing active catalyst species to said stage or stages.

In general, the conversion of the carbonaceous material to lower molecular weight products results in the production of a normally gaseous product, a normally liquid product and a bottoms product which will have characteristics similar to or identical to those of the feed material. In this regard, it should be noted that when the carbonaceous material is a normally solid material, the bottoms product will be normally solid. When the carbonaceous material is a petroleum residuum, on the other hand, the bottoms product may be just a high boiling liquid product. As used herein, the recitation "normally" means at ambient conditions. After the conversion of the carbonaceous material is completed, the several products may be separated into their respective phases using conventional techniques. The catalytic metal or metals, in some form, will, generally, be contained in the bottoms product.

In general, and when a plurality of conversion stages or zones are employed, the gaseous and lighter boiling liquid hydrocarbons will, generally, be separated between each stage. Normally, this separation will include all components having a boiling point below about 350° to about 450° F. Moreover, after the lower boiling point materials have been separated, a portion of the remaining slurry could be recycled to any previous stage to increase the total catalyst concentration in said zone. When a single conversion stage or zone is employed or after the final stage when a plurality of conversion stages or zones is used, the product from the conversion will be separated into at least three product streams. Moreover, in those operations wherein a solvent is used, spent solvent will be separated from the normally liquid product. In this regard, it should be noted that when the carbonaceous material is a solid and particularly coal, lignite, peat or the like, the solvent fraction will, preferably, have an initial boiling point within the range from about 350° to about 650° F. and a final boiling point within the range from about 700° to about 1100° F. When a solvent is used with a petroleum residual, on the other hand, a heavier solvent will, generally, be used and this solvent will, preferably, have an initial boiling point within the range from about 650° F. to about 800° F. and a final boiling point within the range from about 800° F. to about 1100° F.

After the carbonaceous material conversion is completed, the gaseous product may be upgraded to a pipeline gas or the same may be burned to provide energy for the conversion process. Alternatively, all or any portion of the gaseous product may be reformed to provide hydrogen for the hydroconversion process.

The liquid product may be fractionated into essentially any desired product distribution and/or a portion thereof may also be used directly as a fuel or upgraded using conventional techniques. Generally, a naphtha boiling range fraction will be recovered and the naphtha fraction will be further processed to yield a high quality motor gasoline or similar fuel boiling in the naphtha range. Also, a middle distillate fraction may be separated from the liquid product and upgraded for use as a fuel oil or as a diesel oil.

The bottoms product may be gasified, depending upon its carbon content, to produce hydrogen for the conversion process or burned to provide heat for the conversion process. In the case of relatively high conversion, however, and when the carbon content is too low to make either gasification or combustion feasible, the bottoms product may simply be disposed of as a waste material. In this case, all or a portion of the catalyst may be recovered in either an active or inactive form.

PREFERRED EMBODIMENT

In a preferred embodiment of the improved process of the present invention, an ammonium or tetralkyl quartenary ammonium salt of a iron-sulfur analog of cubane containing molybdenum and having the general formula 2 will be used as a catalyst precursor. When a tetralkyl quartenary ammonium salt is used, each of the alkyl groups will be the same and each will contain from about 4 to about 8 carbon atoms. Also, in a preferred embodiment, the salt of the cubane analog will be converted to the corresponding metal sulfide during heat-up of the carbonaceous feed material to the conditions employed in the carbonaceous material conversion stage or zone. Still in a preferred embodiment of the improved process of the present invention, the carbonaceous material will be converted at an average conversion temperature within the range from about 700° to about 870° F., most preferably 750° to 860° F., in the presence of molecular hydrogen at a partial pressure within the range from about 1000 to about 1800 psig, most preferably 1200 to 1600 psig, and at a total pressure within the range from about 800 to about 3000 psig, most preferably 1500 to 2500 psig.

While the improved process of the present invention may be practiced in either a batch or continuous operation and with either a single conversion zone or with a plurality of conversion zones, the improved process of this invention will, preferably, be practiced continuously in a single stage operation. Moreover, in a preferred embodiment of the present invention, a solvent will be employed and the catalyst precursor will be combined with a solvent prior to combining the solvent with the carbonaceous material. In a preferred embodiment, the catalyst concentration will be within the range from about 50 to about 2000 ppm of metal on a weight basis, based on dry, ash-free carbonaceous material and, in a most preferred embodiment, the catalyst concentration will be within the range from about 100 to about 1000 ppm of metal on a weight basis, based on dry, ash-free carbonaceous material. In a most preferred embodiment of the present invention, the salt of the iron-sulfur analog of cubane containing molybdenum will be used as a catalyst precursor in the conversion of a solid carbonaceous material, particularly coal, lignite, peat and the like.

A single stage embodiment of the present invention is illustrated in the attached FIGURE and it is believed that the invention will be better understood by reference to this FIGURE. Referring then to the FIGURE, a carbonaceous material is introduced into preparation vessel 110 through line 111. As indicated, supra, the carbonaceous material may be either normally solid or normally liquid. When the carbonaceous material is solid at the conditions at which it is introduced into preparation vessel 110, the carbonaceous material will be finely divided. In the preparation vessel, the carbonaceous material is combined with a salt of a cubane analog which, as indicated previously, serves as a catalyst precursor, and may be introduced through line 112. In a preferred embodiment, and when the catalyst precursor has been previously combined with a solvent or diluent, the precursor-solvent may be combined in a suitable mixing vessel such as 113. Alternatively, and particularly when a solid carbonaceous material is converted, a suitable solvent for the salt of a cubane analog, different from the process solvent, such as water, when an ammonium salt is used, or an alcohol, amide, aromatic hydrocarbon or the like, when a quartenary ammonium salt is used, could be combined with the salt of a cubane analog in mixing vessel 113 and the solid carbonaceous material then impregnated with the catalyst precursor in preparation vessel 110. When this is done, the solvent used during impregnation will, generally, be separated from the carbonaceous material after the impregnation is complete and before process solvent is combined with the carbonaceous material. Also, when this is done, the process solvent will be added downstream of the missing vessel and after the solvent used for impregnation has been separated.

In the embodiment illustrated, a suitable solvent may be introduced into mixing vessel 113 through line 114 while the catalyst precursor is introduced into mixing vessel 113 through line 115. Generally, agitating means such as agitator 116 will be provided in mixing vessel 113. The mixing vessel may be operated at any suitable temperature to insure that the catalyst precursor is dissolved in the solvent as the mixture is withdrawn through line 117 and passed into line 112. When a solvent is not employed or when the catalyst precursor and solvent are not premixed, the precursor may be fed directly into line 112 from line 115 through line 118. In those embodiments wherein a solvent is used but not combined with a catalyst precursor prior to introduction into preparation vessel 110, a suitable solvent may be introduced through line 119. To insure the preparation of a relatively uniform mixture of carbonaceous material, catalyst precursor (and solvent, when a solvent is employed) preparation vessel 110 may comprise suitable agitation means such as agitator 120.

Generally, the preparation vessel 110 will be operated at conditions suitable for the preparation of a satisfactory mixture and, in any case, at a temperature sufficient to insure that the catalyst precursor remains dissolved in the solvent or, when a solvent is not employed, in the carbonaceous material. After the mixture of carbonaceous material, catalyst precursor (and solvent, when a solvent is employed) is prepared, the same will be withdrawn from the preparation vessel through line 121. The mixture will then be heated to a temperature at or near conversion temperature by passing the same through preheater 122. The mixture is then withdrawn through line 123 and, when a carbonaceous material containing water has been used, the mixture may be passed to flash drum 124 wherein at least a portion of water, as steam may be flashed overhead through line 125 and a mixture suitable for conversion withdrawn through line 126. The mixture is then fed to conversion stage or zone 127 and is combined with molecular hydrogen added through line 128.

In the conversion zone 127, the carbonaceous material will be converted, at least in part, to lighter molecular weight products. The conversion will, generally, be achieved at a temperature within the range from about 500° to about 900° F. and at a total pressure within the range from about 500 to about 7000 psig and with a hydrogen partial pressure within the range from about 400 to about 5000 psig. In a preferred embodiment, the conversion will be achieved at a temperature within the range from within about 700° to about 870° F. at a total pressure within the range from about 800 to about 3000 psig and at a hydrogen partial pressure within the range from about 1000 to about 1800 psig. In a most preferred embodiment of the present invention, the conversion will be accomplished at a temperature within the range from about 750° F. to about 860° F. at a total pressure within the range from about 1500 psig to about 2500 psig and a hydrogen partial pressure within the range from about 1200 psig to about 1600 psig. Gaseous products and any unconsumed hydrogen may be withdrawn from the conversion zone through line 129. The conversion products, except any that may be withdrawn through line 129 and any unreacted feed (and spent solvent, when a solvent is employed) will be withdrawn from the conversion zone 127 through line 130.

The effluent from conversion stage or zone 127 withdrawn through line 130 is then fed to a suitable separator 131. The separator may consist of any suitable means for separating the effluent into its various fractions such as a gaseous fraction, a liquid fraction, and a bottoms fraction which, when a solid carbonaceous material is converted, will be normally solid. Suitable separation devices include, but are not necessarily limited to, knock-out pots, which may be used alone or in combination with filters, centrifuges, distillation apparatus and the like. In a preferred embodiment, and particularly when a solid carbonaceous material is converted, the separation means will be a distillation column comprising an atmospheric and vacuum fractionation column. When such a distillation apparatus is employed, a normally gaseous product may be withdrawn overhead through line 132. Similarly, a bottoms product, which may be normally solid and include unconverted feed, catalyst and ash, may be withdrawn through line 133. The normally liquid product may then be separated into fractions having any desired boiling range or ranges. For example, a relatively light product boiling, generally, within the naphtha range may be withdrawn through line 134. A heavier boiling fraction, for example, a fraction having an initial boiling point within the range from about 350° to about 450° F. and a final boiling point within the range from about 650° F. to about 800° F. may be withdrawn through line 135 and a still higher boiling fraction, for example, a fraction having an initial boiling point within the range from about 650° to about 800° F. and a final boiling point within the range from about 800° to about 1100° F. may be withdrawn through line 136.

In a preferred embodiment and when a solid carbonaceous material is converted, particularly coal, lignite, peat and the like, at least a portion of the material having an initial boiling point within the range from about 350° to about 450° F. and a final boiling point within the range from about 650° to about 800° F. will be recycled and used as a solvent. The recycle may be accomplished through lines 135-135 where the recycle solvent would be introduced into mixing vessel 113 through line 114. When recycled solvent is not, however, used or when the amount of recycle solvent available is not sufficient, extraneous solvent may be introduced into line 114 through line 137. In those cases where the amount of solvent boiling range material is in excess of needs, the excess may be withdrawn through line 138.

While not illustrated, and as indicated, supra, when a petroleum residual is converted in accordance with the process of this invention and when a solvent is employed, the higher boiling fraction withdrawn through line 136 or at least a portion thereof would, normally, be recycled and used as recycle solvent.

Any stream ultimately withdrawn from the separator may be used directly for many purposes as a final product or any or all of the streams may be further upgraded to yield products of enhanced value. For example, the gaseous stream withdrawn from the conversion zone through line 129 and from the atmospheric distillation column through line 132 may be combined, scrubbed to separate pollutants and other non-combustible materials and treated to separate molecular hydrogen to yield a pipeline quality gas. Similarly, the lighter boiling fraction withdrawn through line 134, which may be separated in the motor gasoline range, may be further upgraded to yield a high quality gasoline. A fraction boiling in the middle distillate range may be further treated to yield a middle distillate fuel oil and, in some cases, to yield a diesel fuel. The heaviest boiling fraction withdrawn through line 136 may also be further treated to yield a satisfactory vacuum gas oil which may also be used as a fuel. The bottoms product withdrawn through line 133 may be burned directly to recover its fuel value or the same may be discarded, especially in those cases where the carbon content is too low to support combustion. As indicated previously, all or a part of the catalyst species may be separated prior to discarding. Moreover, a portion of this bottoms stream could be recycled to the conversion zone 127 to increase the concentration of catalyst therein, thereby increasing the total conversion of carbonaceous material during the conversion step and reducing the amount of catalyst precursor added initially.

Having thus broadly described the present invention and a preferred embodiment thereof, it is believed that the same will become even more apparent by reference to the following examples. It will be appreciated, however, that the examples are presented solely for purposes of illustration and should not be construed as limiting the invention.

EXAMPLE 1

In this Example, $[(C_4H_9)_4N]_2[Fe_4S_4(SPh)_4]$ was prepared by dissolving 2.76 g. (120 mmol) of sodium in 120 ml methanol and 12.3 ml (120 mmol) of benzenethiol was then added and 4.86 gms (30 mmol) in a degassed solution of iron (III) chloride and 75 ml methanol was added to the dissolved sodium solution. This resulted in a yellow-black solution. 0.96 gms (10 mmol) of sulfur was then added to the yellow-black solution. A deep brown color resulted after stirring for about 5 minutes. This mixture was then stirred overnight and filtered into a solution of 8.31 gms (22.5 mmol) of tetra-n-butylammoniumiodide in 60 ml methanol. The precipitate was filtered, washed with methanol and dried. The compound was recrystallized from warm (about 50° C.) $CH_3CN$ by the addition of methanol and slowly cooling to −5° C.

170.9 mg. of the $[(C_4H_9)_4N]_2[Fe_4S_4(SPh)_4]$ thus prepared were dissolved in 1.18 g methanol and used to impregnated 3.0 g Illinois No. 6 coal which had previously been dried and ground to 100 mesh. The methanol was removed and the coal was dried. This resulted in a loading of 1 wt. % Fe on dry coal. All handling of the catalyst was done under a nitrogen atmosphere. The 3.0 g of the catalyst-impregnated Illinois No. 6 coal was then mixed with 4.8 g of partially hydrogenated creosote oil (HCO) solvent (1.1 wt. % donatable hydrogen) in a tubing bomb reactor and reacted at 840° F. for 60 minutes at a pressure of 2400 psi in the presence of molecular hydrogen and with agitation. Following the liquefaction reaction, the reaction effluent cooled to room temperature and the total conversion in weight percent coal converted to gas and 1000° F.-liquids and the liquid yield (as determined by cyclohexane extraction) were determined. The total conversion and liquid yield were compared with the total conversion and liquid yield from a parallel base or standard run made in an identical manner, except that no catalyst was placed in the tubing bomb and the increase in both total conversion and liquid yield are summarized in the table following these examples.

EXAMPLE 2

In this example, a series of runs identical to those made in Example 1, except that Wyodak coal was used instead of Illinois No. 6 coal, was completed. Experimental procedures and conditions in both runs were identical to those used in Example 1. The results of these runs are summarized in the table following the examples.

EXAMPLE 3

In this example, $[(C_4H_9)_4N]_3[Mo_2Fe_6S_8(SPh)_9]$ was prepared by first dissolving 0.92 g (40 mmol) of sodium in 40 ml methanol and letting the solution cool to room temperature. 4.11 ml (40 mmol) of benzenethiol was then added to the solution followed by the addition of 1.62 g (10 mmol) of Fe(III) chloride in 20 ml methanol. After stirring, a yellow-black solution was obtained. The addition of 0.87 g (3.3 mmol) of solid ammoniumtetrathiomolybdate to this yellow-black solution then resulted in the rapid formation of a deep red-brown solution which was stirred overnight at room temperature and filtered into a solution of 3.69 g (10 mmol) of $[n\text{-}Bu_4N]I$ in 20 ml methanol resulting immediately in a black precipitate. The precipitate was collected by filtration, washed with methanol and dried. A solid was recrystallized from warm (50° C.) $CH_3CN$ by addition of methanol and cooling to −5° C.

35 mg of the $[(C_4H_9)_4N]_3[Mo_2Fe_6S_8(SPh)_9]$ thus prepared were dissolved in 1.18 g of MeOH and used to impregnated 3.0 g of Illinois No. 6 coal (previously dried and ground to 100 mesh). The methanol was removed and the coal was dried. This resulted in the loading of 1000 ppm of molbydenum and ca. 1746 ppm Fe on dry coal. The catalyst-impregnated coal was then reacted at the same time as an uncatalyzed standard using procedures and conditions identical to those used in Example 1. The results of both runs are summarized in the table following these examples.

EXAMPLE 4

In this example, $[CH_3N(C_8H_{17})_3]_3[Mo_2FE_6S_8(SPh)_9]$ was prepared by first dissolving 7.18 g (312 mmol) of sodium in 312 ml MeOH and allowing the solution to cool to room temperature. 32 ml (312 mmol) benzenethiol was then added followed by the addition of a solution containing 12.6 g (78 mmol) of Fe(III) chloride in 156 ml methanol. After stirring, a yellow-black solution was obtained. Addition of 6.79 g (25.8 mmol) of solid ammoniumtetrathiomolbydate to this yellow-black solution resulted in the rapid formation of a deep red-brown solution which was stirred overnight at room temperature and filtered. 35.6 ml (78 mmol) of $[CH_3N(C_8H_{17})_3]Cl$, was added to the filtrate and stirred. A black-brown tar resulted. The filtrated was decanted off and the resulting tar dried in a vacuum. The tar was dissolved in $CH_3CN$ and NaCl removed by filtration. A black-brown oil remained after removal of $CH_3CN$.

44.6 mg of the $[CH_3N(C_8H_{17})_3]_3[Mo_2FE_6S_8(SPh)_9]$ thus prepared were added to 4.8 g of HCO solvent and 3 g of Illinois No. 6 coal (previously dried and ground to 100 mesh) were mixed with a catalyst solution resulting in a loading of 1000 ppm of molybdenum and ca. 1750 ppm of Fe on dry coal. All handling of the catalyst was done under a nitrogen blanket. The catalyst/coal/-solvent mixture was then reacted, along with an uncatalyzed base or standard, using procedures and conditions identical to those used in Example 1. The results of these runs are summarized in the following table.

TABLE

| Coal | Catalyst | Metal Loading PPM on Dry Coal | Conversion Wt. % on Dry Coal (Normalized) | Conversion Rel. to Base Case Wt % on Dry Coal | Liquid (1000° F. + $H_2O$), Wt % on Dry Coal (Normalized) | Liquid Yield Rel. to Base Case Wt % on Dry Coal |
|---|---|---|---|---|---|---|
| Illinois No. 6 | $[(C_4H_9)_4N]_2Fe_4S_4(SPh)_4$ | 10,000 | 53.7 | +9.4 | 43.8 | +9.5 |
| Wyodak | $[(C_4H_9)_4N]_2Fe_4S_4(SPh)_4$ | 10,000 | 56.3 | 8.2 | 41.0 | +6.7 |
| Illinois No. 6 | $[(C_4H_9)_4N]_3Mo_2Fe_6S_8(SPh)_9$ | 1,000(Mo) | 53.5 | +9.2 | 46.3 | +12.0 |
| Illinois No. 6 | $[CH_3N(C_8H_{17})_3]_3[Mo_2Fe_6S_8(SPh)_9{}^9$ | 1,000(Mo) | 53.5 | +9.0 | 45.3 | +11.0 |

As will be apparent from the foregoing examples and from the results summarized in the table, the catalyst precursors of the present invention result in significant increases in total conversion and liquid yield when compared to the results obtained without a catalyst. As also believed to be readily apparent, this increase in total conversion and liquid yield is realized without a separate treatment of the precursor with sulfur or a sulfur-containing compound.

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention what is claimed is:

1. An improved process for hydroconverting solid carbonaceous materials comprising:

(a) forming a feed mixture of a solid carbonaceous material and an ammonium and/or hydrocarbyl substituted ammonium salt of a metal-sulfur analog of cubane or a mixture of such analogs which metal has hydrogenation catalytic activity when used as a sulfide;

(b) subjecting this mixture to hydroconversion at a temperature within the range from about 500° to about 900° F. at a total pressure within the range from about 500 to about 7000 psig and with a hydrogen partial pressure within the range from about 400 to about 5000 psig; and (c) recovering a normally liquid product from the conversion effluent.

2. The improved process of claim 1 wherein said carbonaceous material is a normally solid carbonaceous material.

3. The improved process of claim 1 wherein the hydroconversion is accomplished at a temperature within the range from about 700° to about 870° F. at a total pressure within the range from about 800 to about 3000 psig and within a hydrogen partial pressure within the range from about 1000 to about 1800 psig.

4. The improved process of claim 1 wherein the hydroconversion is accomplished at a temperature within the range from about 750° to about 860° F. at a total pressure within the range from about 1500 to about 2500 psig and with a hydrogen partial pressure within the range from about 1200 to about 1600 psig.

5. The improved process of claim 1 wherein a sufficient amount of a salt of an analog of cubane or a mixture thereof is added to said mixture to provide from about 10 to about 10,000 ppm metal by weight based on carbonaceous material during the hydroconversion of step (b).

6. The improved process of claim 1 wherein a sufficient amount of a salt of an analog of cubane or a mixture thereof is added to said mixture to provide from about 50 to about 2000 ppm metal by weight based on carbonaceous material during the hydroconversion of step (b).

7. The improved process of claim 1 wherein a sufficient amount of a salt of an analog of cubane or a mixture thereof is added to said mixture to provide from about 100 to about 1000 ppm metal by weight based on carbonaceous material during the hydroconversion of step (b).

8. The improved process of claim 7 wherein the amount of salt of an analog of cubane or a mixture thereof added to the feed mixture is reduced by recycling at least a portion of the bottoms product.

9. The improved process of claim 1 wherein said salt also contains molybdenum.

10. An improved process for hydroconverting a solid carbonaceous material comprising:

(a) forming a feed mixture of a solid carbonaceous material and an ammonium and/or a hydrocarbyl substituted ammonium salt of an metal-sulfur analog of cubane or a mixture of such analogs of cubane, said metal having hydrogenation catalytic activity when used as a sulfide;

(b) subjecting the mixture from step (a) to hydroconversion in the presence of molecular hydrogen at a temperature within the range from about 500° to about 900° F., a total pressure within the range from about 500 to about 7000 psig and at a hydrogen partial pressure within the range from about 400 to about 5000 psig; and (c) recovering a normally liquid product from the effluent of step (b).

11. The improved process of claim 10 wherein said carbonaceous material is a normally solid material.

12. The improved process of claim 11 wherein said normally solid hydrocarbonaceous material is selected from the group consisting of coal, lignite and peat.

13. The improved process of claim 10 wherein the hydroconversion is accomplished at a temperature within the range from about 700° to about 870° F. at a total pressure within the range from about 800 to about 3000 psig and with a hydrogen partial pressure within the range from about 1000 to about 1800 psig.

14. The improved process of claim 10 wherein the hydroconversion is accomplished at a temperature within the range from about 750° to about 860° F. at a total pressure within the range from about 1500 to about 2500 psig and with a hydrogen partial pressure within the range from about 1200 to about 1600 psig.

15. The improved process of claim 10 wherein a sufficient amount of salt or a mixture thereof is added to said mixture to provide from about 10 to about 10,000 ppm metal by weight based on carbonaceous material during the hydroconversion of step (b).

16. The improved process of claim 10 wherein a sufficient amount of salt or a mixture thereof is added to said mixture to provide from about 50 to about 2000 ppm metal by weight based on carbonaceous material during the hydroconversion of step (b).

17. The improved process of claim 10 wherein a sufficient amount of salt or mixture thereof is added to said mixture to provide from about 100 to about 1000 ppm metal by weight based on carbonaceous material during the hydroconversion of step (b).

18. The improved process of claim 10 wherein the amount of salt or mixture thereof added to said feed mixture is reduced by recycling at least a portion of the bottoms product.

19. The improved process of claim 10 wherein the salt also contains molybdenum.

* * * * *